United States Patent [19]

Kauppi

[11] Patent Number: 4,552,616

[45] Date of Patent: Nov. 12, 1985

[54] PULPING PROCESS PRETREATMENT USING A LOWER ALKANOLAMINE IN THE PRESENCE OF AMMONIUM HYDROXIDE

[75] Inventor: Peter K. Kauppi, North Vancouver, Canada

[73] Assignee: New Fibers International Inc., Grand Cayman Island, Cayman Islands

[21] Appl. No.: 536,967

[22] Filed: Sep. 29, 1983

[30] Foreign Application Priority Data

Oct. 20, 1982 [CA] Canada ..... 413857

[51] Int. Cl.[4] ..... D21C 1/06; D21C 3/06; D21C 3/20

[52] U.S. Cl. ..... 162/19; 162/72; 162/84; 162/90

[58] Field of Search ..... 162/19, 65, 72, 83, 162/84, 25, 90, 28

[56] References Cited

U.S. PATENT DOCUMENTS 2,218,479 10/1940 Peterson ..... 162/72
3,773,611 11/1973 Worster et al. ..... 162/65
4,091,749 5/1978 Procter et al. ..... 162/72
4,397,712 8/1983 Gordy ..... 162/72

FOREIGN PATENT DOCUMENTS 0862637 2/1971 Canada ..... 162/84

OTHER PUBLICATIONS

Rydholm; "Pulping Processes; Interscience Publishers; N.Y., 1967, pp. 426–427.

*Primary Examiner*—Steve Alvo
*Attorney, Agent, or Firm*—Bacon & Thomas

[57] ABSTRACT

An improved pulping process for producing high yield pulps from woody lignocellulosic material wherein the lignocellulosic material is treated with a pulping chemical and mechanically defibrated. The improvement comprises pre-treating the lignocellulosic material by impregnating same with a loweralkanolamine so as to cause softening of lignin in the material and to promote fiber separation. As a result, pulping chemical and refining energy consumption as well as vapor and liquid effluent pollution are significantly reduced.

23 Claims, 5 Drawing Figures

PULPING PROCESS PRETREATMENT USING A LOWER ALKANOLAMINE IN THE PRESENCE OF AMMONIUM HYDROXIDE

BACKGROUND OF THE INVENTION

The present invention relates to the production of high yield pulps from wood or other woody lignocellulosic materials, such as chips, shavings and sawdust. More particularly, the invention is directed to a pulping process of the type wherein such lignocellulosic material is treated with pulping chemicals and the treated material is subjected to a mechanical defibration.

Various processes exist for production of chemimechanical and semichemical pulps from wood using pulping chemicals such as NaOH, $Na_2SO_3$, $Na_2S$, $Na_2CO_3$, and $Na_2SO_4$. These processes produce pulp with properties which limit the use of these pulps for low quality and low price products such as corrugating medium, packaging grade, newsprint furnish, etc. Due to a limited fiber separation in pulping, high refining energy requirements are typical for these processes. Furthermore, processes such as chemimechanical pulping process (CMP) and neutral sulfite semichemical pulping process (NSSC) use sulphur-containing chemicals in pulping and thus encounter problems related to air and water pollution and corrosion due to the presence of organic sulfur compounds in the process vapors and water effluents.

In the pulping process disclosed in U.S. Pat. No. 4,116,758, for example, wood chips are first sulfonated to a high degree of sulfonation so as to produce a softening of the lignin in the wood sufficient to permit the wood chips to be readily difibrated into individual fibers by customary mechanical means. This high level of sulfonation which is about 85–90% of the maximum level of sulfonation that can be achieved on wood is obtained by cooking the wood chips in an aqueous solution containing a mixture sulfite and bisulfite in high concentrations. Since the attainment of the high levels of sulfonation required by such a pulping process involves the use of relatively high concentrations of cooking chemicals as well as of relatively heavy applications of cooking liquor on the wood, it becomes necessary for economic considerations to recycle the unreacted sulfite from the cooked chips.

SUMMARY OF THE INVENTION

It is an object of this invention to improve conventional pulping processes using standard pulping chemicals in a manner such as to reduce pulping chemical and refining energy consumption as well as vapor and liquid effluent pollution.

In accordance with the present invention, there is thus provided in a pulping process for producing high yield pulps from woody lignocellulosic material wherein the lignocellulosic material is treated with a pulping chemical and mechanically defibrated, the improvement comprising pre-treating the lignocellulosic material by impregnating same with a loweralkanolamine so as to cause softening of lignin in the material and to promote fiber separation, thereby reducing pulping chemical and refining energy consumption as well as vapor and liquid effluent pollution.

Examples of suitable loweralkanolamines include water-miscible alkanolamines, such as monoethanolamine, diethanolamine, triethanolamine, monoisopropanolamine, diisopropanolamine and triisopropanolamine, monoethanolamine being preferred. Mixtures of these amines can of course also be used.

The pre-treatment step can be carried out using an aqueous solution or water vapor containing the amine. Thus, the lignocellulosic material such as wood chips can first be treated by atmospheric soaking or under heat and pressure conditions in an aqueous solution or water vapor containing the amine or a mixture of various amines to impregnate the wood chips. The amines penetrate into the fiber structure of the wood and react mainly with the lignin contained therein. This reaction causes partial depolymerization of the lignin, for example to an extent of about 1.5 to 5.0%, mainly between fiber elements in middle lamella where about 70% lignin is located, such that softening of the lignin occurs, which in turn promotes good fiber separation without damage to the cellulosic fibers. Amines are markedly hydroscopic and the moisture inherent in the wood, particularly green wood which generally contains more than 50% moisture, causes the amines to readily penetrate into the fiber structure of the wood. The amount of amines penetrating the fiber structure can be controlled by varying for example the impregnation time, temperature, pressure, amine concentration in the solution or vapor, etc.

The amine absorption usually varies with various wood species. The amount of amine required for lignin softening depends on the end product requirements and the chemical and mechanical treatments after the impregnation stage. The required amine amount is preferably comprised between 1.5 and 10.0% by weight, based on dry wood.

The impregnation can be effected according to a batch or continuous-type operation, using conventional equipment such as tanks, batch digesters, etc. In a continuous-type operation, use can be made of an impregnation vessel which includes an inclined screw conveyor and serves as both pre-treatment vessel and drainer to drain excess pre-treatment liquor. An atmospheric impregnation stage, on the other hand, can be designed to serve also as a chip washer to remove sand, dirt, rocks and the like. It should also be noted that the amine impregnation need not be done at the pulp mill site, but can be done elsewhere.

According to a particularly preferred embodiment, the pre-treatment of the lignocellulosic material with a loweralkanolamine is carried out in the presence of ammonium hydroxide. Indeed, it has been found that when carrying out the amine impregnation in the presence of ammonium hydroxide, the physical properties of the pulp are improved, particularly the Breaking Length and Burst Index values. The combined use of a loweralkanolamine and ammonium hydroxide in the pre-treatment step further has a favorable effect on the Concora and Ring Crush values as well as on the Gurley Air Resistance; the pulp yield is also improved. Accordingly, the use of ammonium hydroxide together with a loweralkanolamine makes it possible to tailor the properties of the pulp coming from the pulping chemical treatment stage much more than with the loweralkanolamine alone. The loweralkanolamine and ammonium hydroxide are preferably used in a volume ratio ranging from about 1:3 to about 1:0.5.

After the impregnation stage, the impregnated chips are cooked or otherwise treated with conventional pulping chemicals, prior to being mechanically defibrated in a difibrator or refiner. It should be noted that the pulping chemical treatment and mechanical defibration of chemimechanical pulps can also be effected simultaneously by adding the pulping chemicals to the refiner feed; in this case, no cooking is required. Listed hereinbelow are examples of pulping chemicals which may be used to treat the amine impregnated chips:

(a) $Na_2SO_3$ (chemithermomechanical and chemimechanical pulping processes);

(b) $Na_2SO_3+Na_2CO_3$, pH=6–9 (neutral sulfite semichemical pulping process);

(c) NaOH (soda process);

(d) $NaOH+Na_2SO_3$ (chemimechanical process);

(e) $NaHSO_3$, pH=2–6 (chemimechanical and chemical processes);

(f) standard sulfate (Kraft) pulping liquor containing as active pulping chemicals mainly $NaOH+Na_2S$, and small amounts of other soda chemicals such as $Na_2SO_4$, $Na_2CO_3$, $Na_2SO_3$ and $Na_2S_2O_3$ which do not have much effect on the actual pulping reaction;

(g) standard green pulping liquor obtained from a Kraft pulping process and containing mainly $Na_2CO_3+Na_2S$, and a small amount of $Na_2SO_4$;

(h) standard neutral sulfite pulping liquor containing $Na_2SO_3+Na_2CO_3$ or $NaHCO_3$, optionally with NaOH (neutral sulfite semichemical process);

(i) standard alkaline sulfite pulping liquor containing $Na_2SO_3+NaOH$ or $Na_2S$, pH=10+;

(j) $Mg(HSO_3)_2$, pH=4.5–6.0 (paperpulp process).

It should be noted that all of the above treatment processes, except the Kraft process (f), produce about 75–95% yield pulps. With respect to the Kraft process, the amine pre-treatment of the invention enables the Kraft pulp yield to be increased from 45–55% to approximately 55–65%. For existing Kraft mills, this would mean lower wood requirements and the possibility to increase the mill capacity without problems associated with chemical recovery which usually constitutes a limitation in a pulping process.

The above pulping chemicals can be prepared by conventional processes or purchased as such and mixed at the mill site. Following are some examples how this can be obtained:

Should a pulp mill using the process of the invention on site have an existing Kraft mill, the chemical treatment with $Na_2CO_3$, $Na_2S$, $Na_2SO_4$ (plus small amount of NaOH as buffer, if required) can simply be done by using the green liquor from the Kraft pulping process;

$Na_2SO_3$ and NaOH can be purchased and mixed with water at the mill site without requirements for a complex chemical preparation system;

$Na_2SO_3$ can be purchased or prepared from NaOH and $SO_2$; $SO_2$ can be purchased in liquid form or can be generated by burning sulphur;

$Na_2SO_3$ can also be generated from soda ash ($Na_2CO_3$) and $SO_2$ at the mill site by standard processes.

It should also be noted that any of these pulping liquors can be buffered with NaOH, $Na_2O$ or $SO_2$ to provide more alkalinity or make the cooking liquor more acidic depending on the requirements.

As already mentioned, due to the amine pretreatment of the invention which causes lignin softening and promotes good fiber separation as well as more uniform and faster penetration of chemicals, further treatment with pulping chemicals is required to a lesser extent than in conventional pulping processes without such amine pre-treatment step. The standard pulping chemical requirements in conventional pulping processes compared with the chemical pulping requirements in the improved pulping processes of the invention with amine pre-treatment are reported by way of example in Table 1:

TABLE 1

| Pulping Chemicals | Conventional Process with no Amine Pre-Treatment | Improved Process with Amine Pre-Treatment |
|---|---|---|
| $Na_2SO_3$ (CMP) | 1.3–3.0% | 0.5–2.0% |
| $Na_2SO_3$ + $Na_2CO_3$ (CMP) | 3.0–4.0% | 1.2–2.5% |
| NaOH* (paperpulp & CMP) | 3.0–12.0% | 1.5–7.0% |
| NaOH + $Na_2SO_3$ (CMP) | (1.3–3.0%) + (1.3–3.0%) | (0.5–1.8%) + (0.5–1.8%) |
| $NaHSO_3$ (CMP) | 4.0–5.0% | 2.0–3.0% |
| Kraft pulping liquor | 9.0–18% (1) | 6.0–12.0% (1) |
| Green pulping liquor from Kraft process | 7.0–8.0% (1) | 4.0–5.0% (1) |
| Neutral sulfite semi-chemical (NSSC) pulping liquor | 8.0–9.5% (2) | 4.5–6.5% (2) |

CMP = Chemimechanical Pulping Process

*Used for making writing and printing papers as well as corrugating medium pulps.

(1) Active alkali requirements expressed as $Na_2O$.

(2) Active alkali requirements expressed as $Na_2O$, using hardwoods.

The sulphur consumption in the process of the invention (also water and air pollution from sulphur) is reduced in about the same ratio as the chemical consumption is reduced.

The invention thus provides an improved and versatile pulping process for producing various grades of high yield pulps from hardwoods, mixtures of hardwoods, softwoods, straws and annual plants. As explained above, improved lignin softening and fiber separation is obtained by impregnating wood chips or the like with lower alkanolamines such as monoethanolamine before the chips are cooked or otherwise treated with conventional pulping chemicals. Due to the impregnation with amines, refining power requirements of these pulps are lower than those of conventional pulps. Lower amounts of conventional pulping chemicals are required for pulping, less sulphur is used in pulping decreasing equipment corrosion, water effluent pollution as well as air pollution from pulp mills. Process condensates and vapors contain less organic.sulphur compounds than those of standard processes. Condensates and vapor containing amines are not toxic and harmfull; indeed, amines are not toxic at all and the amine pre-treatment of the invention does not provide any pollution.

The process of the invention can be used for new mills producing various grades of high yield pulps (80–95% yield) with better physical properties and greater versatility than with those processes using standard pulping chemicals only. For existing pulp mills using processes such as the thermomechanical, chemimechanical, chemithermomechanical, neutral sulfite semichemical pulping processes and soda process, the process of the invention enables the physical properties of these pulps to be improved, and is more versatile and easily adaptable for changes in market demands. The amine pre-treatment can be easily adapted to existing mills.

Due to the impregnation of the wood chips with amines and the resulting softening of the lignin, as explained above, further treatment with conventional pulping chemicals is required to lesser extent than in conventional processes to produce various grades of pulp. It is important to keep sulphur content to minimum to minimize water and air pollution of a pulp mill. The process of the invention does not require as much sulphur or sodium containing chemicals as standard processes. The exact type of pulping chemicals and amounts required depend of course on the wood species used as starting material and the desired properties of the end product. As only a small portion of these chemicals are required in the process of the invention, the requirements for expensive chemical recovery system for sulphur is minimized and the pollution load of sulphur in water effluent and process vapors is minimized.

BRIEF DESCRIPTION OF THE DRAWINGS

Further features and advantages of the present invention will become more readily apparent from the following description of a pulping process embodying the invention, as well as from working examples thereof, with reference to appended drawings, in which.

DESCRIPTION OF PREFERRED EMBODIMENTS

Figure 1:
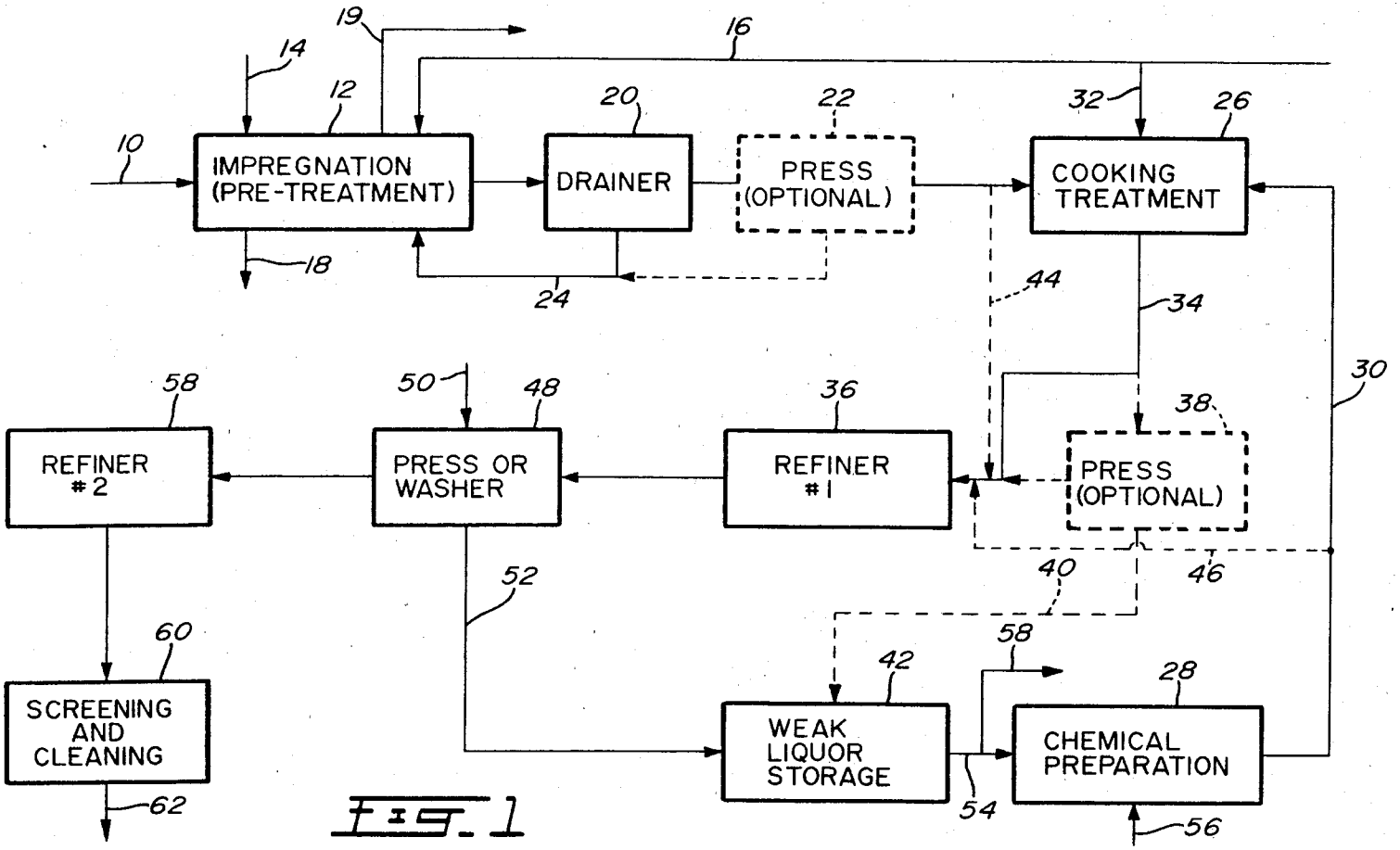
FIG. 1 is a block flow diagram of a pulping process according to the invention.

Referring first to FIG. 1, green wood chips are fed through line 10 to an impregnation vessel 12 containing an aqueous solution of a loweralkanolamine such as monoethanolamine which serves to pre-treat the chips so as to soften the lignin therein. Make-up solution of the amine is fed via line 14 and the pre-treatment liquor is heated with steam fed through line 16. Sand, dirt, rocks and the like are removed from the vessel via line 18. When the pre-treatment is carried out under pressure, vent gases can be directed to a heat recovery unit via line 19.

After impregnation, the chips are passed to a conventional drainer 20, which may include a screen or perforated bottom conveyor so as to drain away excess pre-treatment liquor, and are then optionally fed to a conventional press 22 such as a screw press, disc press, drum press or the like to remove more pre-treatment liquor from the chips and to obtain chips having a high oven-dry wood content. The spent liquor removed from the drainer 20 and optional press 22 is recycled via line 24 to the impregnation vessel 12 to recover chemicals, water and heat.

After pressing, the impregnated chips are fed to a cooking vessel 26 for treatment with conventional pulping chemicals supplied from the chemical preparation unit 28 via the fed line 30. Steam is admitted via line 32 to heat the pulping liquor and chips. The pulping chemical treatment can be carried out under atmospheric or pressure conditions. The impregnated and cooked chips are thereafter fed via line 34 to a conventional refiner 36 so as to be subjected to mechanical defibration. Before being mechanically defibrated, the chips may optionally be fed to a press 38 to remove excess pulping liquor which is sent via line 40 to the weak liquor storage tank 42.

In an alternative embodiment suitable for the production of chemimechanical pulps, a portion (for example 25%) of amine impregnated but uncooked chips may be fed from the press 22 via line 44 directly to the refiner 36 into which pulping chemicals may be charged via line 46. Thus, by varying the proportions of impregnated uncooked chips and of impregnated cooked chips fed to the refiner 36, various grades of pulp can be produced to meet the desired physical properties of the pulps. This provides a great flexibility to produce various pulp grades which cannot be done with conventional processes.

After the first refining stage 36, the pulp slurry is fed to a press or washer unit 48 into which water is admitted via line 50. The spent pulping liquor and washing water recovered from the unit 48 are sent via line 52 to the weak liquor storage tank 42, to save chemicals and water and to minimize water effluent load from the mill. The weak liquor contained in the tank 42 is recycled via line 54 to the chemical preparation unit 28 into which make-up pulping chemicals may be fed through line 56, or a portion thereof may be sent to a chemical recovery unit via line 58.

After the pressing or washing stage 48, the pulp is fed to a second refiner 58 to achieve the desired freeness. The pulp is thereafter subjected to a screening and cleaning treatment in the unit 60 to produce an end product having the desired physical properties, which is discharged via line 62.

As it is apparent, the invention provides an extremely versatile pulping process.

The following non-limiting examples further illustrate this invention.

EXAMPLE 1

In the manufacture of chemimechanical, chemithermomechanical and corrugating medium type pulps, wood chips are impregnated in an aqueous solution containing an alkanolamine and having a temperature of 180°–205° F. from 15 to 90 minutes and are then cooked with conventional pulping chemicals under controlled temperature and pressure conditions. The amine concentration in the impregnation liquor which varies depending on the impregnation conditions such as time, temperature, liquor to wood ratio, type of wood, etc. is generally comprised between 30 and 100 g/l. The cooking temperature for corrugating medium type pulps is usually 330°–355° F., for 12–25 minutes, at saturated steam pressure when a continuous digester is used. The treatment (cooking) conditions for chemimechanical type pulps vary, but the temperature is usually approximately 280°–330° F. at saturated steam pressure, and the cooking time can vary from a few minutes to 60 minutes. An exception is cold soda CMP pulp which could require several hours treatment (soaking) at the room temperature of 80°–100° F.

The amine impregnation can be carried out under pressure and heat conditions for pulp grades which require higher physical properties. For example, the amine impregnation can be done at temperatures of 245°-300° F., under saturated steam pressure for a time period of 15-30 minutes prior to cooking with a Kraft pulping liquor. Vent gases from the amine treatment vessel can be directed to a heat recovery system to recover heat and chemicals. Kraft cooking is carried out at temperatures of 330°-345° F. under saturated steam pressure, and the cooking time is approximately 60-90 minutes, total cover to cover time being 3.5-4.0 hours when batch digesters are used. The following is typical cooking cycle for a Kraft batch digester:

| Item | Unit | Amount |
|---|---|---|
| Cooking Cycle | | |
| Chip and liquor filling and cover on | min. | 40 |
| Time to temperature | min. | 90 |
| Time at temperature | min. | 60 |
| Relief | min. | 15 |
| Blowing | min. | 20 |
| Total cover to cover time | min. | 225 |

Liquor to wood ratio when cooked in an aqueous solution of chemicals is usually 3.5-4.5 to 1. This means that the cooking vessel contains 3.5-5.0 times more cooking liquor, including wood moisture, than dry wood.

EXAMPLE 2—Spruce Cooks

| | |
|---|---|
| Moisture content of green chips | 34% |
| Amount of green chips per treatment | 2.3 kg |
| Amount of water per treatment | 18.9 l |
| Amount of monoethanolamine per treatment | 40 ml |
| Amount of ammonium hydroxide - varied as indicated hereinbelow. | |
| Number of treatments: Four (4) - S7, S8, S9 and S10. | |

All cooks were heated with steam under atmospheric conditions for 5 minutes and were cooked for approximately 60 minutes at the cooking temperature of 300°-320° F. In all cooks, the cooking liquor was circulated by a pump and the liquor indirectly heated by steam.

The pre-treatment was carried out using monoethanolamine and ammonium hydroxide in the following amounts:

| Treatment No. | Monoethanolamine (ml) | Ammonium Hydroxide (ml) |
|---|---|---|
| S7 | 40 | 20 |
| S8 | 40 | 0 |
| S9 | 40 | 40 |
| S10 | 40 | 80 |

Figure 2B:
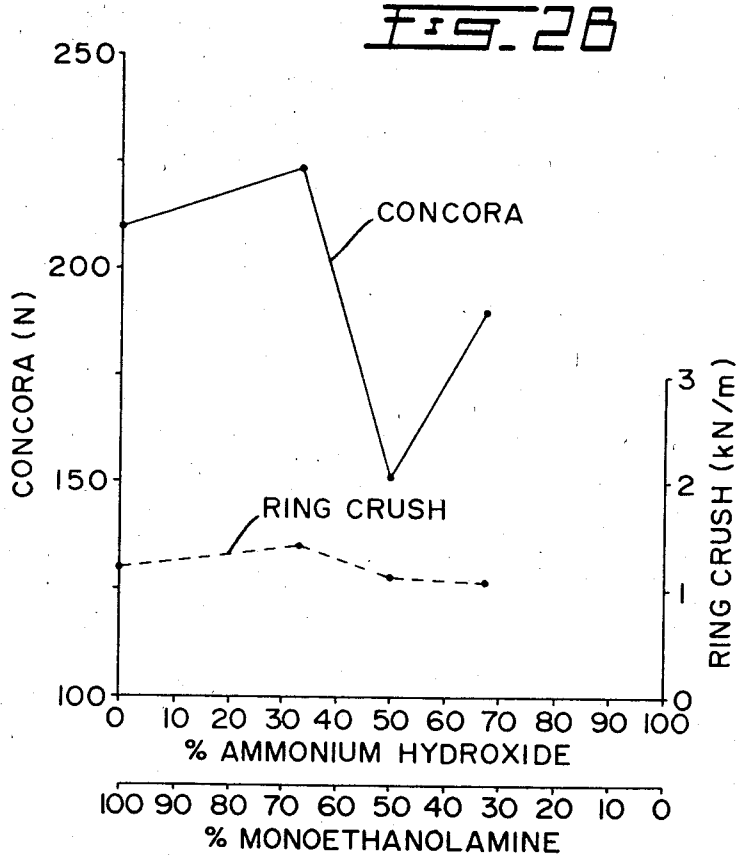
FIGS. 2A, 2B and 2C are diagrams showing the variations in pulp properties of spruce chips treated in accordance with Example 2.
Figure 2A:
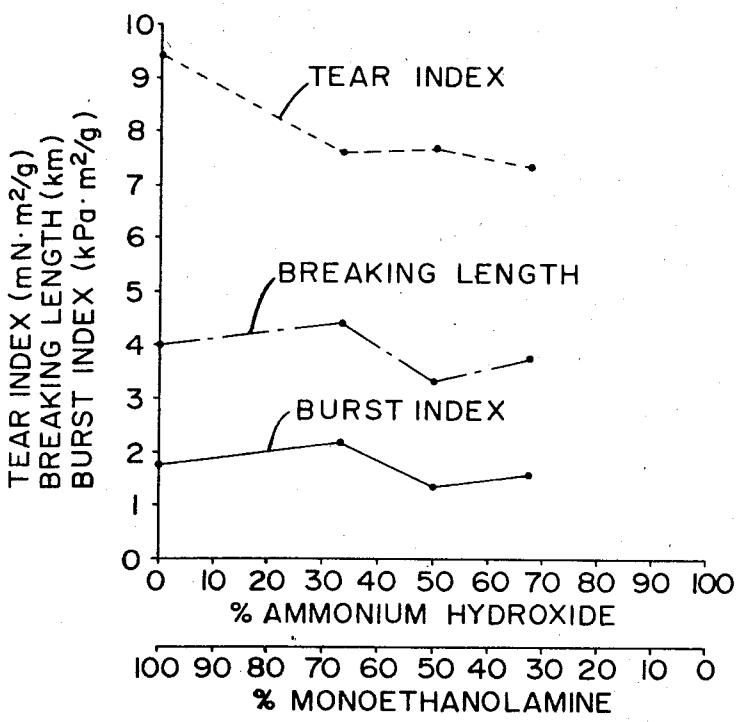
Figure 2C:
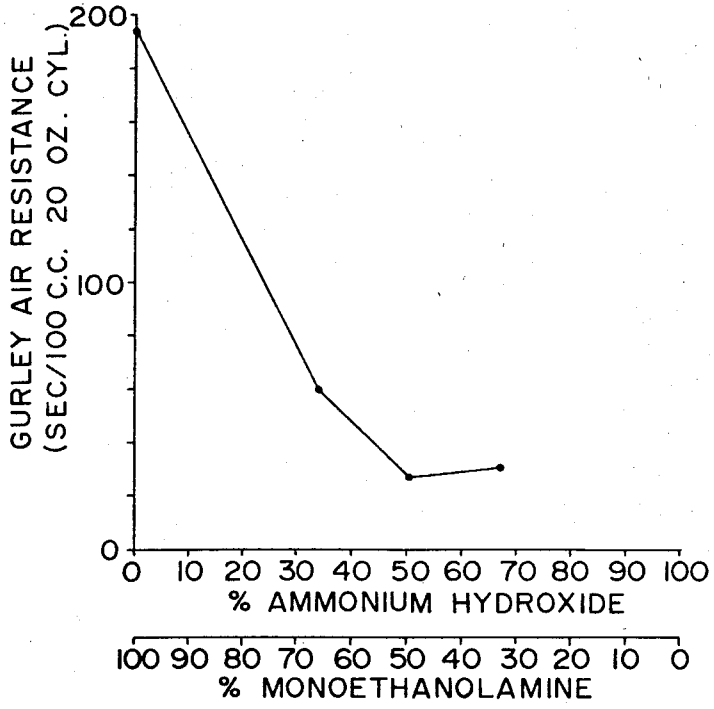

The treated chips were then refined and tested for paper properties at approximately 300 CSF. The test results are reported in Table 2 and shown in FIGS. 2A, 2B and 2C.

TABLE 2

| Treatment No. | Tear Index ($mN \cdot m^2/g$) | Breaking Length (km) | Burst Index ($kPa \cdot m^2/g$) | Conora (N) | Ring Crush (kN/m) | Gurley Air Resistance (sec/100 cc 20 oz. cyl.) |
|---|---|---|---|---|---|---|
| S7 | 7.62 | 4.44 | 2.11 | 222.18 | 1.41 | 59.57 |
| S8 | 9.45 | 3.99 | 1.81 | 209.06 | 1.22 | 193.70 |
| S9 | 7.70 | 3.23 | 1.39 | 151.01 | 1.12 | 27.53 |
| S10 | 7.28 | 3.74 | 1.49 | 189.26 | 1.14 | 31.40 |

As it is apparent for these results, by selecting the appropriate amounts of pre-treatment chemicals, one can tailor the pulp properties to suit any requirements.

In this respect, the Burst Index is an important specification value for linerboard grade classification whereas the Tear Index is an important value in box performance.

Concora and Ring Crush values are important classification for stiffeners of packaging grades such as corrugating medium and linerboards.

The Gurley Air Resistance figures, on the other hand, are indicative of the dewatering characteristics of the pulp. The lower and figure, the better the paper machine opertion.

EXAMPLE 3—Aspen Cooks

| | |
|---|---|
| Moisture content of green chips | 20% approx. |
| Amount of green chips per treatment | 2.3 kg |
| Amount of water per treatment | 4.0 l |
| Amount of monoethanolamine per treatment | 25 ml |
| Amount of ammonium hydroxide - varied as indicated hereinbelow. | |
| Number of treatments: Three (3) - AS5, AS8 and AS9. | |

All cooks were heated with direct steam and held at 270°-300° F. for 20 minutes and blown down. No circulating pump was used.

The pre-treatment was carried out using monoethanolamine and ammonium hydroxide in the following amounts:

| Treatment No. | Monoethanolamine (ml) | Ammonium Hydroxyde (ml) |
|---|---|---|
| AS5 | 25 | 75 |
| AS8 | 25 | 25 |
| AS9 | 25 | 0 |

Figure 3:
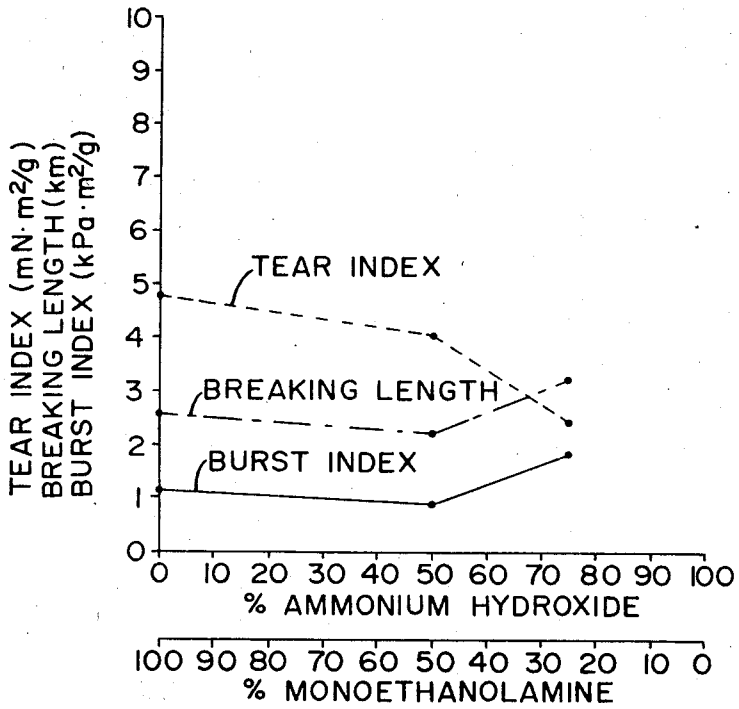
FIG. 3 is a diagram similar to that of FIG. 2A showing the variations in pulp properties of aspen chips treated in accordance with Example 3.

The treated chips were then refined and tested for paper properties at 300 CSF. The test results are reported in Table 3 and shown in FIG. 3.

TABLE 3

| Treatment No. | Tear Index ($mN \cdot m^2/g$) | Breaking Length (km) | Burst Index ($kPa \cdot m^2/g$) |
|---|---|---|---|
| AS5 | 2.52 | 3.2 | 1.90 |
| AS8 | 4.00 | 2.3 | 0.97 |
| AS9 | 4.80 | 2.6 | 1.06 |

EXAMPLE 4—Southern Pine Cook

The standard Kraft cook was modified by starting with 10 minutes pre-steaming followed by impregnation of the chips with a solution containing monoethanolamine and ammonium hydroxide in a ratio (volume) of 1:1:5. After impregnation, the chips were cooked with standard Kraft chemicals using approximately 10.5% active alkali on O.D. wood expressed as $Na_2O$. Sulfidity was approximately 30%. The cooking was carried out according to the following procedure:

| | |
|---|---|
| time to temperature | 90 min. |
| time at temperature | 60 min. |
| cooking temperature | 168° C. |
| liquor to wood ratio | 4:1 |

The results obtained are reported in Table 4 and compared with those obtainable in a standard Kraft process (without pre-treatment with a lower alkanolamine/ammonium hydroxide mixture).

TABLE 4

| | Modified Kraft | Standard Kraft |
|---|---|---|
| CSF | 313 | 295 |
| Burst Index (kPa · $m^2$/g) | 7.4 | 6.26 |
| Tear Index (mN · $m^2$/g) | 20.25 | 17.4 |
| Breaking Length (km) | 8.35 | 8.1 |
| Yield (%) | 57.4 | 54–55 |
| Kappa No. | 126 | 90 |
| Active alkali as $Na_2O$ on O.D. wood (%) | 10.5 | 14–15 |

As can be seen from this example, the pulp yield is also improved.

I claim:

1. A pulping process for producing a high yield pulp from woody lignocellulosic material comprising pretreating said lignocellulosic material by impregnating same with a loweralkanolamine in the presence of ammonium hydroxide, prior to contact with said pulping chemical, in amounts sufficient to improve the dewatering characteristics of the high yield pulp and to cause softening of lignin in said material and to promote fiber separation, adding a pulping chemical to the impregnated material and mechanically defibrating the material, said pretreatment reducing pulping chemical and refining energy consumption as well as vapor and liquid effluent pollution.

2. A process as claimed in claim 25, wherein said loweralkanolamine is a water-miscible alkanolamine selected from the group consisting of monoethanolamine, diethanolamine, triethanolamine, monoisopropanolamine, diisopropanolamine, triisopropanolamine and mixtures thereof.

3. A process as claimed in claim 2, wherein said loweralkanolamine is monoethanolamine or monoisopropanolamine, or a mixture thereof.

4. A process as claimed in claim 2, wherein said pretreatment is carried out using an aqueous solution or water vapor containing said loweralkanolamine.

5. A process as claimed in claim 4, wherein said pretreatment is carried under heat and pressure conditions.

6. A process as claimed in claim 1, wherein said pretreatment is carried on a continuous basis in an impregnation vessel which includes an inclined screw conveyor and serves as both pre-treatment vessel and drainer to drain excess pre-treatment liquor.

7. A process as claimed in claim 1, wherein said lignocellulosic material is impregnated with an amount of loweralkanolamine comprised between 1.5 and 10.0% by weight, based on dry wood.

8. A process as claimed in claim 1, wherein said pulping chemical comprises sodium sulfite.

9. A process as claimed in claim 1, wherein said pulping chemical comprises a mixture of sodium sulfite and sodium carbonate.

10. A process as claimed in claim 1, wherein said pulping chemical comprises sodium hydroxide.

11. A process as claimed in claim 1, wherein said pulping chemical comprises a mixture of sodium hydroxide and sodium sulfite.

12. A process as claimed in claim 1, wherein said pulping chemical comprises sodium bisulfite.

13. A process as claimed in claim 1, wherein said pulping chemical comprises a sulfate Kraft pulping liquor containing sodium hydroxide and sodium sulfide.

14. A process as claimed in claim 13, wherein the loweralkanolamine used in said pre-treatment is monoethanolamine.

15. A process as claimed in claim 14, wherein the monoethanolamine and ammonium hydroxide are used in a volume ratio of about 1:1.5.

16. A process as claimed in claim 1, wherein said pulping chemical comprises a green pulping liquor obtained from a Kraft pulping process and containing sodium carbonate, sodium sulfide and sodium sulfate.

17. A process as claimed in claim 1, wherein said pulping chemical comprises a neutral sulfite pulping liquor containing sodium sulfite in admixture with sodium carbonate or sodium bicarbonate.

18. A process as claimed in claim 1, wherein said pulping chemical comprises an alkaline sulfite pulping liquor containing sodium sulfite in admixture with sodium hydroxide or sodium sulfide.

19. A process as claimed in claim 1, wherein said pulping chemical comprises magnesium bisulfite.

20. A process as claimed in claim 1, wherein said pulping chemical is buffered with sulfur dioxide.

21. A process as claimed in claim 1, wherein said pulping chemical is buffered with sodium oxide.

22. A process as claimed in claim 1, wherein the lower-alkanolamine and ammonium hydroxide are used in a volume ratio ranging from about 1:3 to about 1:0.5.

23. A process as claimed in claim 22, wherein the loweralkanolamine used in said pre-treatment is monoethanolamine.

* * * * *

UNITED STATES PATENT AND TRADEMARK OFFICE

CERTIFICATE OF CORRECTION

PATENT NO. : 4,552,616

DATED : November 12, 1985

INVENTOR(S) : Kauppi

It is certified that error appears in the above-identified patent and that said Letters Patent is hereby corrected as shown below:

Claim 2, line 1, change "claim 25" to -- claim 1 --.

Signed and Sealed this

*Thirteenth* Day of *May 1986*

[SEAL]

*Attest:*

DONALD J. QUIGG

*Attesting Officer*

*Commissioner of Patents and Trademarks*